US005701952A

United States Patent [19]

Stickel

[11] Patent Number: 5,701,952

[45] Date of Patent: Dec. 30, 1997

[54] WATER-CONDUCTING HOUSEHOLD APPLIANCE

[75] Inventor: Ernst Stickel, Giengen, Germany

[73] Assignee: Bosch-Siemens Hausgeraete GmbH, Munich, Germany

[21] Appl. No.: 681,595

[22] Filed: Jul. 29, 1996

Related U.S. Application Data

[63] Continuation of Ser. No. 205,528, Mar. 3, 1994, abandoned.

[30] Foreign Application Priority Data

Mar. 3, 1993 [DE] Germany ..... 43 06 643.7

[51] Int. Cl.[6] ..... B08B 3/04

[52] U.S. Cl. ..... 165/168; 134/95.1; 220/577

[58] Field of Search ..... 165/168; 220/4.13, 220/577; 134/95.1, 107; 68/902; 137/574

[56] References Cited

U.S. PATENT DOCUMENTS

| | | | |
|---|---|---|---|
| 1,456,452 | 5/1923 | Linden | 220/577 X |
| 3,041,212 | 6/1962 | Booth | 134/107 X |
| 3,638,666 | 2/1972 | Fishman | 134/95.1 X |
| 3,863,657 | 2/1975 | Irving | 134/95.1 X |

*Primary Examiner*—John Fox
*Attorney, Agent, or Firm*—Herbert L. Lerner; Laurence A. Greenberg

[57] ABSTRACT

A water-conducting household appliance includes a container which receives a heated liquid and has a wall. A partition of thermally conductive material is disposed in the container adjacent the wall and is substantially water-tightly joined with the wall. A supply container is formed between the partition and the wall and is thermally conductively connected to the container.

8 Claims, 1 Drawing Sheet

WATER-CONDUCTING HOUSEHOLD APPLIANCE

This application is a continuation of application Ser. No. 08/205,528, filed Mar. 3, 1994 abandoned.

BACKGROUND OF THE INVENTION

FIELD OF THE INVENTION

The invention relates to a water-conducting or water-carrying household appliance having a container containing heated liquid, and a supply container being thermally conductively connected with the container.

Water-conducting household appliances of that type are known, for instance, from German Published, Non-Prosecuted Applications DE-OS 27 30 489 and 30 21 746, and so forth. The supply containers in the known prior art are used to hold in reserve liquids that are intended to be used in a subsequent portion of one complete cycle of the appliance. The thermally conductive connection of the container is provided in the prior art as a structure having a sheet-metal wall on the container, as in German Published, Non-Prosecuted Application DE-OS 30 21 746. The container itself is likewise formed of sheet metal in the prior art. When a supply container is used in dishwashers or washing machines in the prior art, it is formed of sheet stainless steel.

German Petty Patent DE-GM 17 04 904 has disclosed another water-conducting household appliance of the type referred to at the outset, in which a back wall of the sheet-metal container is formed as a hollow body that is used as a supply container. The partition between the container which contains heated liquid, and the supply container, is constructed as a relatively thin sheet-metal wall that is a good thermal conductor.

In the aforementioned known water-conducting household appliances with sheet-metal containers, not only is production complicated and expensive but a thermal insulation from the outside, which is also complicated and expensive, is needed in order to avoid energy losses from heat radiation.

In order to avoid those disadvantages it is known, for instance from German Published, Non-Prosecuted Application DE-OS 26 52 308, to make such containers, which contain heated liquid, of plastic. However, because of the thermal-insulation properties of plastics, which can be used to make containers of water-conducting household appliances, the previously known structure of thermally conductively connected supply containers or walls being constructed as hollow bodies and resting on a container wall is not possible.

SUMMARY OF THE INVENTION

It is accordingly an object of the invention to provide a water-conducting household appliance, which overcomes the hereinafore-mentioned disadvantages of the heretofore-known devices of this general type, which has a container of plastic containing heated liquid for creating a thermally conductively connected supply container in a simple way, and which nevertheless is also suitable for an appliance of this type that instead has a sheet-metal container containing heated liquid.

With the foregoing and other objects in view there is provided, in accordance with the invention, a water-conducting household appliance, comprising a container for receiving a heated liquid, the container having a wall; a partition of thermally conductive material being disposed in the container adjacent the wall and being substantially water-tightly joined with the wall; and a supply container being formed between the partition and the wall and being thermally conductively connected to the container.

Due to the disposition of the supply container in the container that contains heated liquid, a thermally conductively connected supply container is created in a simple manner for a water-conducting household appliance having a plastic container containing heated liquid. However, the supply container is also suitable for an appliance of this kind that has a container of sheet metal containing heated liquid. Due to the heat-insulating properties of plastics, it is unnecessary to provide an additional, complicated and expensive thermal insulation from the outside in order to avoid energy losses from heat radiation. Since the supply container is disposed in the container that contains heated liquid, no particularly great attention needs to be paid to the water tightness of the connection between the partition and the associated wall of the container, and this further simplifies production.

In accordance with another feature of the invention, the partition is fastened to the associated wall of the container by means of at least one dome being integrally formed on in the wall of the container and by means of at least one screw passed through at least one opening in the partition. This provides further simplification of production as well as of the structural conditions and of the installation of the partition.

In accordance with a further feature of the invention, the opening in the partition is equipped with a passage protruding in the direction of the associated wall of the container. The installation of the partition is advantageously facilitated in this way.

In accordance with an added feature of the invention, there is provided a seal having an opening for the screw, being inserted into the opening in the partition and having a larger cross section, in the direction toward the associated walls of the container, than the opening in the partition. In this way, simple sealing of the fastening configuration of the partition to the associated wall of the container is achieved.

In accordance with an additional feature of the invention, the partition is fastened to the associated wall of the container by means of at least one dome being formed integrally onto the wall of the container, protruding through an opening in the partition, resting on the surface of the partition and being heat-deformed, after the partition has been mounted. This provides further simplification of production and of structural conditions as well as of installation of the partition.

In accordance with yet another feature of the invention, an outer edge of the partition is sealed off all the way around with respect to the associated wall of the container. This creates simple sealing of the supply container.

In accordance with yet a further feature of the invention, there is provided an encompassing seal on which the edge of the partition rests, which is inserted into a groove that is integrally formed onto the associated wall of the container and extends all the way around along the edge of the partition. This preferentially further simplifies sealing and installation of the supply container.

In accordance with yet an added feature of the invention, the encompassing seal is constructed in such a way as to compensate for differences in the thermal expansion of the associated wall of the container and of the partition. Through the use of this provision, leaks caused by differing longitudinal expansion are effectively avoided.

In accordance with yet an additional feature of the invention, there is provided a lower edge of the partition which is pressed against the associated wall of the container and/or the encompassing seal by means of a reinforcement strip mounted on the associated wall of the container. This is done in order to effectively avoid leaks in the lower region of the supply container, which is under particularly heavy strain.

In accordance with again another feature of the invention, the pressing function of the reinforcement strip is suitably improved by providing that the reinforcement strip is disposed under the encompassing seal on the associated wall of the container in such a way that it covers the seal.

In accordance with again a further feature of the invention, the reinforcement strip is fastened to the associated wall of the container by means of at least one screw or by means of at least one dome being formed integrally onto the wall of the container and protruding through an opening in the reinforcement strip, the dome being heat-deformed and resting on the surface of the reinforcement strip, after mounting of the reinforcement strip has been done. The fastening and installation of the reinforcement strip are especially advantageously facilitated in this way.

In accordance with again an added feature of the invention, the wall of the container associated with the partition is the back wall of the container. This contributes to further simplification of production and of the structural conditions.

In accordance with a concomitant feature of the invention, in order to avoid corrosion, the partition is made of stainless steel.

Other features which are considered as characteristic for the invention are set forth in the appended claims.

Although the invention is illustrated and described herein as embodied in a water-conducting household appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
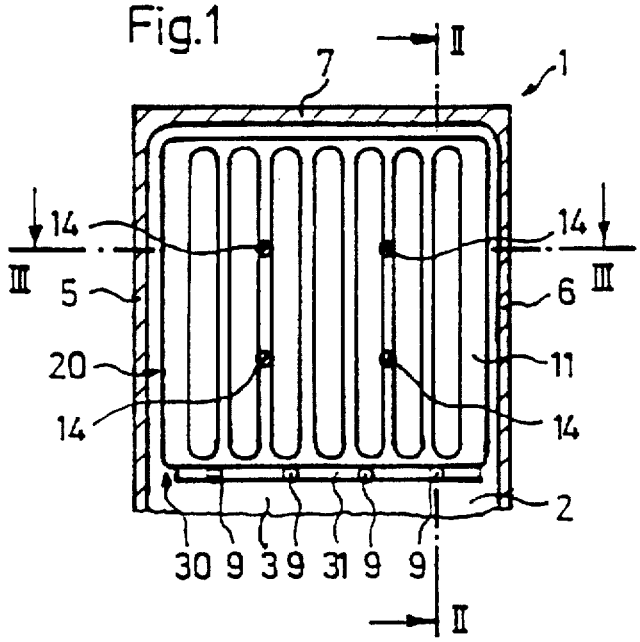
FIG. 1 is a fragmentary, diagrammatic, longitudinal-sectional view of a container, containing heated liquid, of a water-conducting household appliance according to the invention, with a front region removed.

Referring now in detail to the figures of the drawing as a whole, there is seen a water-conducting or water-carrying household appliance 1 according to the invention which has a container 2 that contains heated liquid. Thermally conductively connected to the container 2 is a supply container 10, into which a further liquid is introduced. According to the invention, the supply container 10 is formed between a partition 11 of thermally conductive material which is disposed in the container 2, and a wall 3 of the container 2 disposed adjacent the partition 11. In the embodiments shown, the wall 3 of the container 2 which is associated with the partition 11 is the back wall of the container 2. The partition 11 is made from stainless steel.

Figure 3:
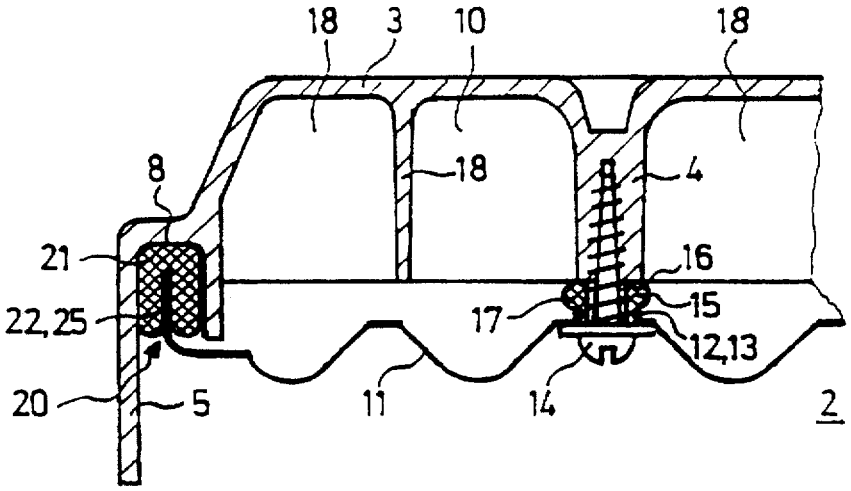
FIG. 3 is an enlarged, fragmentary, cross-sectional view of the container containing heated liquid, according to an advantageous embodiment of the invention, which is taken along a line III—III of FIG. 1, in the direction of the arrows.

A fastening of the partition 11 to the back wall 3 of the container 2, which is chosen in the illustrated embodiments, is shown in FIG. 3. The partition 11 is fastened to the back wall 3 of the container 2 by means of domes 4, four of which are integrally formed onto the back wall 3 of the container 2 in the illustrated exemplary embodiments, and by means of a number of screws 14 passing through a corresponding number of openings 12 in the partition 11. The openings 12 in the partition 11 are each equipped with a passage 13 protruding in the direction of the back wall 3 of the container 2. One seal 15 with an opening 16 for the screw 14 is inserted into each of the openings 12 in the partition 11. The seal 15 has a support collar 17 with a larger cross section in the direction of the back wall 3 of the container 2 than the opening 15 in the partition 11.

The partition 11 is joined in essentially water-tight fashion to the back wall 3 of the container 2. An outer edge 20 of the partition 11 is sealed off from the back wall 3 of the container 2 all the way around. To that end, an encompassing seal 21, 21', on which the edge 20 of the partition 11 rests, is inserted into a groove 8, 8' that is integrally formed into the back wall 3 of the container 2 and extends all the way around the edge 20 of the partition 11. The encompassing seal 21, 21' is constructed in such a way as to compensate for differences in the thermal expansion of the back wall 3 of the container 2 and the thermal expansion of the partition 11.

Figure 4:
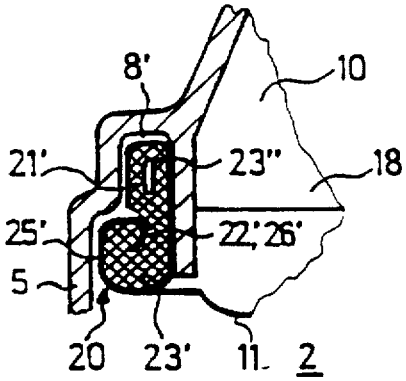
FIG. 4 is an enlarged, fragmentary, cross-sectional view of the container containing heated liquid, according to a further embodiment of the invention, which is taken along a line III—III of FIG. 1, in the direction of the arrows.

FIGS. 3 and 4 illustrate two different embodiments of the seals 21, 21', which extend along two side walls 5, 6 of a top 7 of the container 2 and along a lower region of the edge 20 of the partition 11. The seals 21, 21' having a suitable construction of a lateral bend 25, 25' at the edge.

In the preferred embodiment of FIG. 3, the seal 21 is constructed with a large volume in a U shape and has a receiving groove 22. The peripheral bend 25 of the partition 11, which is bent essentially at a right angle, is inserted in prestressed fashion into the receiving groove 22.

In the further embodiment in FIG. 4, the seal 21' has a more-complex cross section, in which a front region 23' has an essentially round receiving groove 22' for the insertion of the peripheral bend 25'. The receiving groove 22' is bent essentially at a right angle and is provided with an essentially round termination 26'. An inner region 23" of the seal 21' is narrower than the front region 23', and correspondingly the encompassing groove 8' is equipped with two regions of differing widths.

Figure 2:
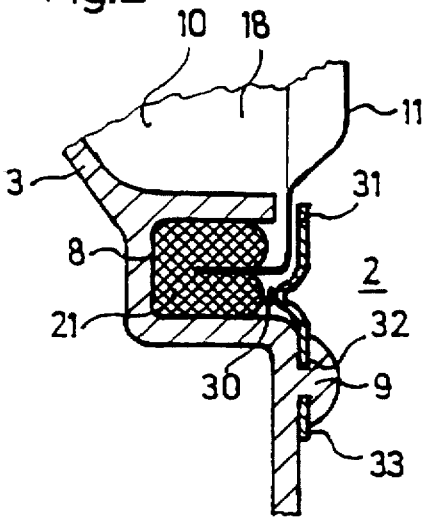
FIG. 2 is an enlarged, fragmentary, longitudinal-sectional view of the container containing heated liquid, which is taken along a line II—II of FIG. 1, in the direction of the arrows.

It is common to both illustrated embodiments that a reinforcement strip 31 is mounted on the back wall 3 of the container 2, and a lower edge 30 of the partition 11 is pressed by the reinforcement strip 31 against the back wall 3 of the container 2 and/or the encompassing seal 21. As can be seen from FIG. 2, the reinforcement strip 31 is disposed underneath the encompassing seal 21 on the back wall 3 of the container 2, in such a way that it covers the seal 21. In the exemplary embodiments shown, the reinforcement strip 31 is fastened to the back wall 3 of the container 2 by means of four domes 9, which correspond in number to the domes 4, which protrude through a corresponding number of openings 32 in the reinforcement strip 31 and which are formed integrally onto the back wall 3 of the container 2. After mounting of the reinforcement strip 31, these domes are heat-deformed and rest on a surface 33 of the reinforcement strip. For reinforcement purposes, the back wall 3 is also equipped with integrally formed-on, intersecting longitudinal and transverse ribs 18.

In a further embodiment, the partition 11 may be fastened to the associated wall 3 of the container 2 by means of at least one dome which is integrally formed onto the wall 3 of the container 2 and protrudes through an opening in the partition 11. In the same manner as the fastening by deformation of the dome 9, such a dome formed on the wall 3 is heat-deformed and rests on the surface of the partition, after the mounting of the partition. By the same token, at least one screw, like the screw 14, can fasten the reinforcement strip 31 to the wall 3 instead of using the dome 9.

In another embodiment, the reinforcement strip may be fastened to the associated wall of the container by means of a corresponding number of screws, which are screwed through a corresponding number of openings in the reinforcement strip into a corresponding number of domes formed integrally onto the back wall of the container.

I claim:

1. A water-conducting household appliance, comprising:

a container for receiving a heated liquid, said container having a wall;

a partition of thermally conductive material being disposed in said container adjacent said wall and being substantially water tightly joined with said wall;

a supply container for receiving a supply liquid, said supply container being formed between said partition and said wall and being thermally conductively connected to said container;

said partition having an outer edge sealed off all the way around relative to said wall; and a groove integrally formed in said wall and extending all the way around along said outer edge of said partition, and an encompassing seal being inserted into said groove, said outer edge of said partition resting on said encompassing seal.

2. The water-conducting household appliance according to claim 1, wherein said encompassing seal compensates for differences in thermal expansion of said wall and said partition.

3. A water-conducting household appliance, comprising:

a container for receiving a heated liquid, said container having a wall;

a partition of thermally conductive material being disposed in said container adjacent said wall and being substantially water-tightly joined with said wall, said partition having a lower edge;

a supply container being formed between said partition and said wall and being thermally conductively connected to said container; and a reinforcement strip mounted on said wall for pressing said lower edge of said partition against said wall.

4. The water-conducting household appliance according to claim 1, including a lower edge of said partition, and a reinforcement strip mounted on said wall for pressing said lower edge of said partition against said encompassing seal.

5. The water-conducting household appliance according to claim 1, including a lower edge of said partition, and a reinforcement strip mounted on said wall for pressing said lower edge of said partition against said wall and said encompassing seal.

6. The water-conducting household appliance according to claim 4, wherein said reinforcement strip is disposed under said encompassing seal on said wall and covers said seal.

7. The water-conducting household appliance according to claim 3, including at least one dome being formed integrally onto said wall, protruding through an opening formed in said reinforcement strip, being heat-deformed after said reinforcement strip has been mounted and resting on a surface of said reinforcement strip, for fastening said reinforcement strip to said wall.

8. The water-conducting household appliance according to claim 3, including at least one screw for fastening said reinforcement strip to said wall.

* * * * *